United States Patent [19]

Morris

[11] Patent Number: 4,657,063

[45] Date of Patent: Apr. 14, 1987

[54] FOAM PATTERN FOR CASTING AN AIR COOLED CYLINDER HEAD

[75] Inventor: Richard L. Morris, Collierville, Tenn.

[73] Assignee: Outboard Marin Corporation, Waukegan, Ill.

[21] Appl. No.: 735,207

[22] Filed: May 17, 1985

[51] Int. Cl.[4] ..... B22D 7/02; B22D 9/04

[52] U.S. Cl. ..... 164/45; 164/34; 164/246; 164/249

[58] Field of Search ..... 164/34, 35, 36, 45, 164/235, 246, 249; 123/41.69

[56] References Cited

U.S. PATENT DOCUMENTS

| | | | |
|---|---|---|---|
| Re. 31,488 | 1/1984 | Trumbauer | 164/34 |
| 2,461,416 | 2/1949 | Erdle | 164/45 |
| 3,302,256 | 2/1967 | Wittmoser | 164/246 |
| 3,848,654 | 11/1974 | Boyle et al. | 164/34 |
| 4,015,654 | 4/1977 | Witchell | 164/45 |
| 4,197,899 | 4/1980 | Ernest | 164/34 |
| 4,216,746 | 8/1980 | Freyn | 123/41.69 |
| 4,231,413 | 11/1980 | Bretzger | 164/45 |
| 4,462,453 | 7/1984 | Trumbauer | 164/34 |

OTHER PUBLICATIONS

PCT Application No. PCT/US79/0074; filing date Feb. 9, 1979.

*Primary Examiner*—Nicholas P. Godici
*Assistant Examiner*—Richard K. Seidel
*Attorney, Agent, or Firm*—Michael, Best & Friedrich

[57] ABSTRACT

A method of fabricating a foam mold pattern for forming an air cooled cylinder head in a lost foam casting process, the cylinder head including a cooling fin, the method comprising the steps of: fabricating a foam mold pattern fin portion including a cooling fin, fabricating a foam mold pattern main portion, and attaching the fin portion to the main portion.

17 Claims, 6 Drawing Figures

FOAM PATTERN FOR CASTING AN AIR COOLED CYLINDER HEAD

BACKGROUND OF THE INVENTION

The invention relates to methods and apparatus for metal casting, and more particularly to methods and apparatus for casting an air cooled cylinder head in a lost foam casting process. Even more particularly, the invention relates to foam patterns and methods for making foam patterns for casting an air cooled cylinder head in a lost foam casting process.

A foam mold pattern for use in a lost foam casting process is commonly formed by injecting polystyrene beads into a mold having a cavity with the shape of the desired foam pattern. While the polystyrene beads can theoretically have any size, the most readily available and by far most economical size is that used in forming styrofoam cups. Smaller beads are much more expensive, or even unobtainable. When using conventional methods, it is difficult if not impossible to obtain satisfactory "fill out" of a foam pattern, or of the passages of a mold cavity used in forming a foam pattern, if any portion of the foam pattern having a significant length (one inch, for example) has a thickness of less than three to four times the diameter of the beads being used to form the pattern. When using conventionally sized beads, it is difficult to fill out pattern portions having a thickness of less than 0.180 inches A thickness of 0.180 inches is too thick for effective cooling fins on an air cooled cylinder head. Thus, a foam pattern for an air cooled cylinder head with satisfactorily thin cooling fins cannot be formed by molding the pattern in one piece, because the "fins" of the pattern will not satisfactorily fill out.

It is known in the lost foam casting art to form a foam pattern by gluing various pieces of a pattern together.

Attention is directed to the following United States patents which relate to casting with evaporative patterns and to casting of engine parts:

| | | |
|---|---|---|
| Ernest | 4,197,899 | April 15, 1980 |
| Erdle | 2,461,416 | February 8, 1949 |
| Wittmoser | 3,302,256 | February 7, 1967 |
| Boyle | 3,898,654 | November 19, 1974 |
| Witchell | 4,015,654 | April 5, 1977 |
| Bretzger | 4,231,413 | November 4, 1980 |
| Trumbauer | Re.31,488 | January 10, 1984 |
| Trumbauer | 4,462,453 | July 31, 1984 |

SUMMARY OF THE INVENTION

The invention provides a method of fabricating a foam mold pattern for forming an air cooled cylinder head in a lost foam casting process, the cylinder head including a cooling fin, the method comprising the steps of: fabricating a foam mold pattern fin portion including a cooling fin, fabricating a foam mold pattern main portion, and attaching the fin portion to the main portion.

In one embodiment, the first fabricating step includes the steps of providing a mold including a cavity having the shape of the fin portion, the mold cavity including a fin cavity portion having a base, and injecting foam particles into the mold cavity at a point adjacent the base of the fin cavity portion.

In one embodiment, the first fabricating step includes the steps of providing foam particles having a diameter, providing a mold comprising a cavity having the shape of the fin portion and including a fin cavity portion having a base, a thickness of approximately two particle diameters, and a length of approximately one inch, and injecting the foam particles into the mold cavity at a point adjacent the base of the fin cavity portion.

In one embodiment, the attaching step includes the step of gluing the fin portion to the main portion.

In one embodiment, the first fabricating step includes the step of fabricating a fin portion including a plurality of cooling fins.

The invention also provides a method of fabricating a foam mold pattern for forming an air cooled cylinder head in a lost foam casting process, the cylinder head including an exhaust port, an exhaust passage, an inlet port, an inlet passage, and a cooling fin, the method comprising the steps of: fabricating a foam mold pattern fin portion including a cooling fin by providing foam particles having a diameter, providing a mold comprising a cavity having the shape of the fin portion and including a fin cavity portion having a base, a thickness of approximately two particle diameters, and a length of approximately one inch, and by injecting the foam particles into the mold cavity at a point adjacent the base of the fin cavity portion, fabricating a foam mold pattern main portion including an exhaust port, an exhaust passage, an inlet port, and an inlet passage, and gluing the fin portion to the main portion.

The invention also provides a foam mold pattern for casting an air cooled cylinder head in a lost foam casting process, the foam mold pattern comprising a foam mold pattern main portion forming a cylinder head, and a foam mold pattern fin portion attached to the main portion and including a cooling fin.

In one embodiment, the pattern is made of foam particles having a diameter, and the cooling fin has a thickness of approximately two particular diameters and a length of approximately one inch.

In one embodiment, the main portion includes a first subportion, and a second subportion attached to the first subportion, and the fin portion is attached to the first subportion.

In one embodiment, the pattern further comprises a second fin portion attached to the first subportion, and the second subportion is attached to the first subportion and to the second fin portion.

In one embodiment, the first subportion includes an intake port, a portion of an intake passage, a portion of an exhaust port, and a portion of an exhaust passage, the second fin portion includes a portion of the exhaust port and a portion of the exhaust passage, and the second subportion includes a portion of the exhaust passage and a portion of the intake passage.

A principal feature of the invention is the provision of a method comprising the steps of fabricating a foam mold pattern fin portion including a cooling fin by providing a mold comprising a cavity having the shape of the fin portion and including a fin cavity portion having a base, and by injecting foam particles into the mold cavity at a point adjacent the base of the fin cavity portion, fabricating a foam mold pattern main portion, and attaching the fin portion to the main portion. This method produces a foam pattern for an air cooled cylinder head with satisfactorily thin cooling fins, since it allows the forming of pattern portions having a thickness of approximately two bead diameters rather than three to four bead diameters. When using conventionally sized beads, this method can produce cooling fins having a length of approximately one inch and a thickness of approximately 0.090 inches.

Another principal feature of the invention is the provision of a foam mold pattern for casting an air cooled cylinder head in a lost foam process, the foam mold pattern comprising a foam mold pattern main portion forming a cylinder head, and a foam mold pattern fin portion attached to the main portion and including one or more a cooling fins.

Other features and advantages of the invention will become apparent to those skilled in the art upon review of the following detailed description, claims, and drawings.

Figure 1:
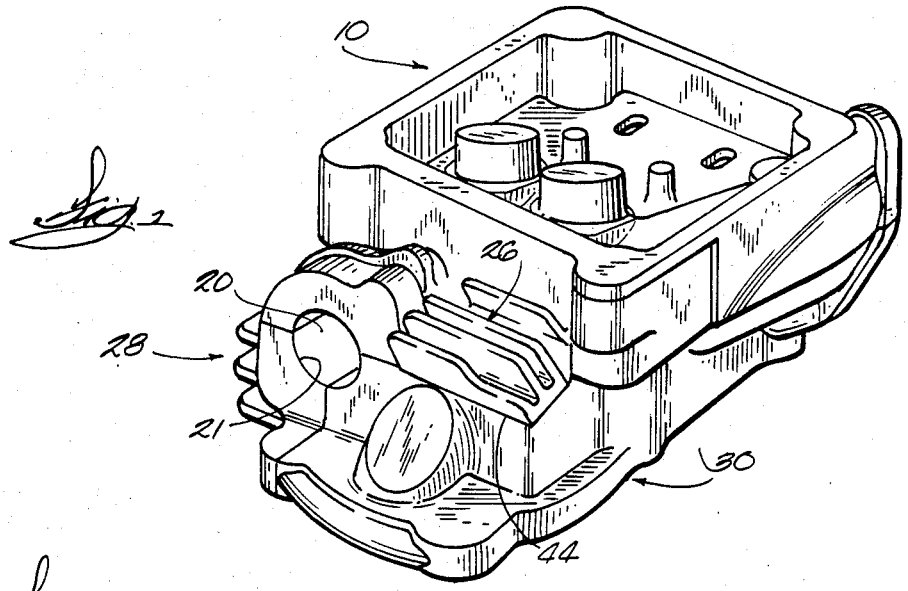
FIG. 1 is a perspective view of a foam mold pattern embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A foam mold pattern 10 embodying the invention is illustrated in the drawings. While it is to be understood that the foam pattern 10 is not a cylinder head, but rather a foam pattern having structure identical to a cylinder head to be made therewith, the foam pattern 10 will be described using the terminology that would be used in describing a cylinder head. For example, the passage in the foam pattern 10 that corresponds to the exhaust passage of the cylinder head will be referred to as the exhaust passage of the foam pattern 10.

Figure 6:
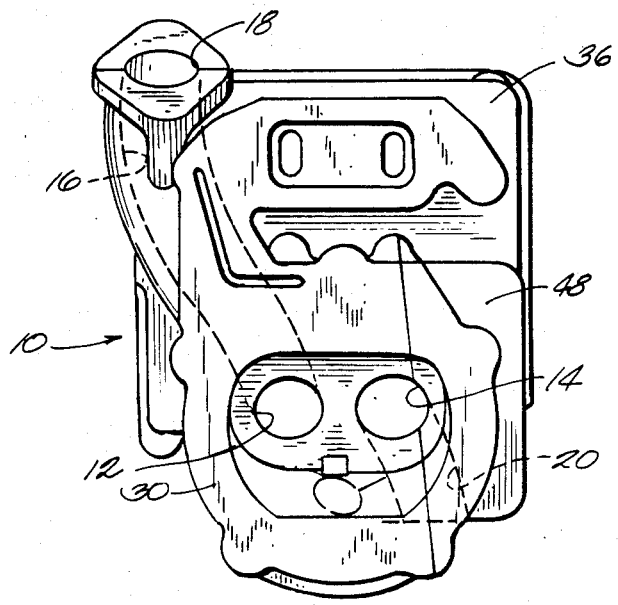
FIG. 6 is a bottom view of the pattern.

As best shown in FIG. 6, a bottom view, the foam pattern 10 includes a downwardly opening inlet port 12 and a downwardly opening exhaust port 14. The foam pattern 10 also includes an inlet passage 16 communicating between the inlet port 12 and an inlet opening 18, and an exhaust passage 20 communicating between the exhaust port 14 and an exhaust opening 21 (FIG. 1). The foam pattern 10 further includes first and second sets of cooling fins 26 and 28 (FIG. 1) having a thickness of approximately 0.090 inches and a length of approximately one inch.

Figure 2:
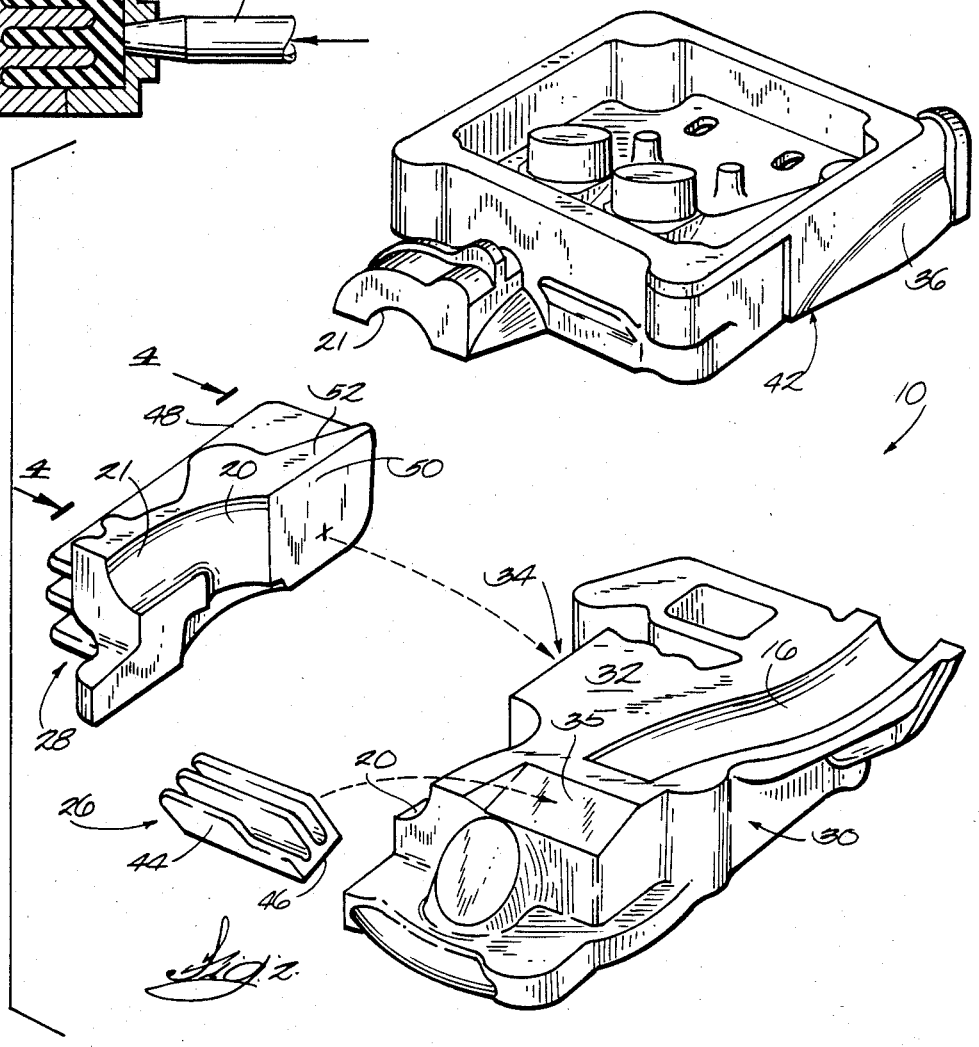
FIG. 2 is an exploded view of the foam mold pattern.

The foam pattern 10 comprises a main portion including a first or lower subportion 30 including the intake port 12 and a portion of the exhaust port 14, as best shown in FIGS. 2 and 6. The first subportion 30 also includes a lower portion of the inlet passage 16, and a portion of the exhaust passage 20, as best shown in FIG. 2. The first subportion 30 has a generally flat upper surface 32, a side surface 34 located adjacent the exhaust port 14 and exhaust passage 20, and a surface 35 located adjacent the inlet port 12 and inlet passage 16.

Figure 5:
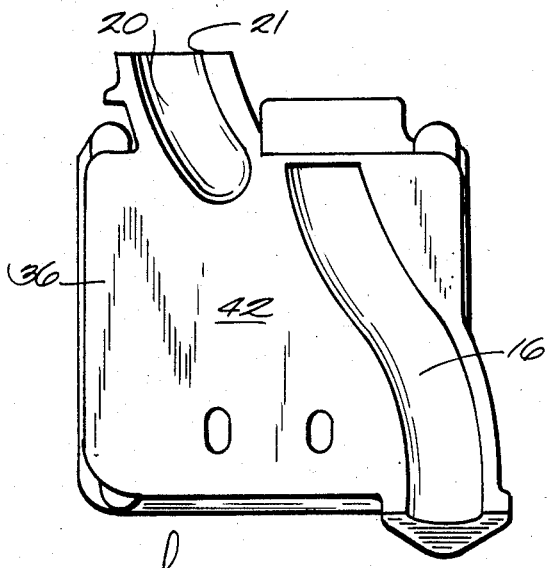
FIG. 5 is a bottom view of the upper subportion of the main portion of the pattern.

The main portion also includes a second or upper subportion 36 including an upper portion of the inlet passage 16, and an upper portion of the exhaust passage 20, as best shown in FIG. 5. The second subportion 36 has a lower surface 42 which is generally flat and is adapted to mate with the upper surface 32 of the first subportion 30.

The foam pattern 10 further comprises a first fin portion 44 (FIG. 2) including the first set of cooling fins 26. The first fin portion 44 has a bottom surface 46 which is generally flat and is closely spaced from and parallel to the base of the cooling fins 26. The bottom surface 46 is adapted to mate with the surface 35 on the first subportion 30.

Figure 4:
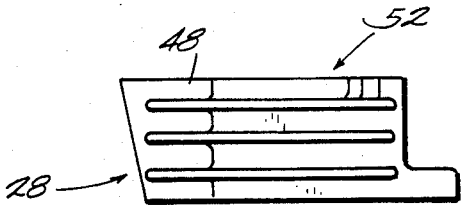
FIG. 4 is a side view, taken along line 4—4 in FIG. 2, of one of the fin portions of the foam mold pattern.

The foam pattern 10 further comprises a second fin portion 48 (FIGS. 2 and 4) including the second set of cooling fins 28, a portion of the exhaust port 14 (FIG. 2), and a lower portion of the exhaust passage 20. The second fin portion 48 has a bottom surface 50 which is generally flat and is closely spaced from and parallel to the base of the cooling fins 28. The bottom surface 50 is adapted to mate with the side surface 34 of the first subportion 30. The second fin portion 48 also has an upper surface 52 adapted to mate with a portion of the lower surface 42 of the second subportion 36.

The exhaust port 14, exhaust passage 20, inlet port 12, and inlet passage 16 are divided among the first and second subportions 30 and 36 and the second fin portion 48 as described above and as shown in the drawings in order to simplify fabrication of the pieces of the foam pattern 10 by simplifying the molds required for fabrication of those pieces.

Figure 3:
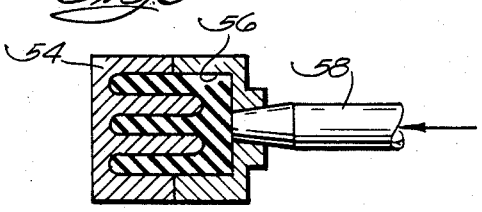
FIG. 3 is a cross-sectional view of a mold used in forming a fin portion of the foam mold pattern.

In accordance with the method of the invention, each of the fin portions 44 and 48 is fabricated by providing a mold 54 (the mold of the first fin portion 44 is shown in FIG. 3) including a cavity 56 which has the shape of the desired fin portion, and which includes fin cavity portions corresponding to the cooling fins and having a base corresponding to the base of the cooling fins. The fin cavity portions have a thickness of approximately 0.100 inches, and a length of approximately 1 inch, these dimensions corresponding to the dimensions of the cooling fins. Fabrication of the fin portion is preferably completed by injecting foam particles having a diameter into the mold cavity 56 with a foam spray nozzle 58 at a point adjacent the base of the fin cavity portions. By this it is meant that the nozzle is placed such that the beads follow a relatively straight and short path into the fin cavity portions. If the beads must turn corners or travel too far to enter the fin cavity portions, they will lose kinetic energy and will not satisfactorily fill out the fin cavity portions. It has been found during testing that a relatively straight path is more important than a relatively short path. Thus, conventionally sized beads can travel more than two inches over a relatively straight path to fill out cooling fins having a thickness of 0.090 inches (approximately two particle diameters) and a length of one inch. It has also been found that fins having a length of greater than one inch can be filled out if the thickness is greater than 0.090 inches.

This method allows the fabrication of cooling fins having a thickness of approximately two particle diameters rather than three to four particle diameters.

The fabrication of the first fin portion 44 is illustrated in FIG. 3. The location of the nozzle used in fabricating the second fin portion 48 is illustrated by an X in FIG. 2.

The first and second subportions 30 and 36 of the main portion can be fabricated by using conventional processes used for forming foam patterns. When all four pieces of the foam pattern 10 have been fabricated, the foam pattern 10 is assembled by attaching the base 46 of the first fin portion 44 to the corresponding surface 35 on the first subportion 30, by attaching the base 50 of the second fin portion 48 to the corresponding side surface 34 of the first subportion 30, and by attaching the lower surface 42 of the second subportion 36 to the corresponding upper surfaces 32 and 52 of the first subportion 30 and second fin portion 48. Preferably, these pieces are attached by gluing the corresponding surfaces together, as is known in the art.

Various other features and advantages of the invention are set forth in the following claims.

I claim:

1. A method of fabricating a foam mold pattern for forming an air cooled cylinder head in a lost foam casting process, the cylinder head including a cooling fin, said method comprising the steps of: fabricating a foam mold pattern fin portion adapted to form a cooling fin, fabricating a foam mold pattern main portion, and attaching said fin portion to said main portion.

2. A method as set forth in claim 1 wherein said fin portion fabricating step includes the steps of providing a mold including a cavity having the shape of said fin portion, said mold cavity including a fin cavity portion having a base, and injecting foam particles into said mold cavity at a point adjacent said base of said fin cavity portion.

3. A method as set forth in claim 1 wherein said fin portion fabricating step includes the steps of providing foam particles having a diameter, providing a mold comprising a cavity having the shape of said fin portion and including a fin cavity portion having a base with a thickness of approximately two particle diameters and with a length of approximately one inch, and injecting said foam particles into said mold cavity at a point adjacent said base of said fin cavity portion.

4. A method as set forth in claim 1 wherein said attaching step includes the step of gluing said fin portion to said main portion.

5. A method as set forth in claim 1 wherein said fin portion fabricating step includes the step of fabricating a fin portion, adapted to form a plurality of cooling fins.

6. A method of fabricating a foam mold pattern for forming an air cooled cylinder head in a lost foam casting process, the cylinder head including an exhaust port, an exhaust passage, an inlet port, an inlet passage, and a cooling fin, said method comprising the steps of: fabricating a foam mold pattern fin portion adapted to form a cooling fin by first providing foam particles having a diameter, by also providing a mold comprising a cavity having the shape of said fin portion and including a fin cavity portion having a base with a thickness of approximately two particle diameter and with a length of approximately one inch, and by next injecting said foam particles into said mold cavity at a point adjacent said base of said fin cavity portion, by also fabricating a foam mold pattern main portion including an exhaust port, an exhaust passage, an inlet port, and an inlet passage, and finally by gluing said fin portion to said main portion.

7. A foam mold pattern for casting an air cooled cylinder head in a lost foam casting process, said foam mold pattern comprising a foam mold pattern main portion, adapted to form a cylinder head, and a foam mold patterm fin portion attached to said main portion and adapted to form a cooling fin.

8. A foam mold pattern as set forth in claim 7 wherein said pattern is made of foam particles having a diameter, and wherein said fin portion includes a subsection with a thickness of approximately two particle diameters and a length of approximately one inch.

9. A foam mold pattern as set forth in claim 7 wherein said fin portion is glued to said main portion.

10. A foam mold pattern as set forth in claim 7 wherein said fin portion is adpated to form a plurality of cooling fins.

11. A foam molding pattern as set forth in claim 7 wherein said main portion includes a first suportion, and a second subportion attached to said first subportion, and wherein said fin portion is attached to said first subportion.

12. A foam mold pattern as set forth in claim 11 and further comprising a second fin portion adapted to form a cooling fin and attached to said first subportion, and wherein said second subportion is attached to said first subportion and to said second fin portion.

13. A foam mold pattern as set forth in claim 12 wherein said first subportion is adapted to form an intake port, a portion of an intake passage, a portion of an exhaust port, and a portion of an exhaust passage, wherein said second fin portion is also adapted to form a portion of said exhaust port and a portion of said exhaust passage, and wherein said second subportion is adapted to form a portion of said exhaust passage and a portion of said intake passage.

14. A foam mold pattern for casting an air cooled cylinder head in a lost foam casting process, said foam mold pattern comprising a main foam mold pattern portion adapted to form a cylinder head and including a first subportion adapted to form an intake port, a portion of an intake passage, a portion of an exhaust port, and a portion of an exhaust passage, and a second subportion attached to said first subportion and adapted to form a portion of said exhaust passage and a portion of said intake passage, a first foam mold pattern fin portion attached to said first subportion and adapted to form a plurality of cooling fins, and a second foam mold pattern fin portion attached to said first subportion and to said second subportion and adapted to form a plurality of cooling fins, a portion of said exhaust port, and a portion of said exhaust passage.

15. A foam mold pattern as set forth in claim 14 wherein said pattern is made of foam particles having a diameter, and wherein said first and second fin portions each have sub-sections with a thickness of approximately two particle diameters and a length of approximately one inch.

16. A method of fabricating a foam pattern for forming a part of an air cooled engine in a lost foam casting process, the engine part including a cooling fin, said method comprising the steps of: fabricating a foam pattern fin portion adapted to form a cooling fin, fabricating a foam pattern main portion, and attaching said fin portion to said main portion.

17. A foam pattern for casting a part of an air-cooled engine in a lost foam casting process, said foam pattern comprising a foam pattern main portion adapted to form an engine part, and a foam pattern fin portion attached to said main portion and adapted to form a cooling fin.

* * * * *